US009554959B2

(12) United States Patent
Carn

(10) Patent No.: US 9,554,959 B2
(45) Date of Patent: Jan. 31, 2017

(54) ANTERIOR PELVIC SUPPORT DEVICE FOR A SURGERY PATIENT

(71) Applicant: Ronald M. Carn, Redding, CA (US)

(72) Inventor: Ronald M. Carn, Redding, CA (US)

( * ) Notice: Subject to any disclaimer, the term of this patent is extended or adjusted under 35 U.S.C. 154(b) by 444 days.

(21) Appl. No.: 14/012,279

(22) Filed: Aug. 28, 2013

(65) Prior Publication Data

US 2014/0059773 A1 Mar. 6, 2014

Related U.S. Application Data

(60) Provisional application No. 61/694,687, filed on Aug. 29, 2012.

(51) Int. Cl.

| | |
|---|---|
| ***A61G 13/12*** | (2006.01) |
| ***A61G 13/00*** | (2006.01) |
| ***A61G 13/10*** | (2006.01) |

(52) U.S. Cl.

CPC ..... *A61G 13/123* (2013.01); *A61G 13/0036* (2013.01); *A61G 13/101* (2013.01); *A61G 2013/0081* (2013.01); *A61G 2200/16* (2013.01); *A61G 2200/322* (2013.01)

(58) Field of Classification Search

CPC ..... A47C 20/02; A47C 20/021; A47C 20/023; A47C 20/026; A47C 20/027; A61G 7/065; A61G 7/07; A61G 7/075; A61G 13/101; A61G 13/12; A61G 13/1225; A61G 13/123; A61G 13/1235; A61G 13/1245; A61G 2013/0054; A61G 2013/0081; A61G 13/0036; A61G 2200/322; A61G 2200/16

See application file for complete search history.

(56) References Cited

U.S. PATENT DOCUMENTS

| | | | | |
|---|---|---|---|---|
| 1,516,795 A * | 11/1924 | Schwarting | ..... | A61G 13/12 248/118 |
| 2,735,738 A | 2/1956 | Berne | | |
| 3,389,702 A * | 6/1968 | Kennedy | ..... | A61B 17/42 5/631 |
| 3,844,550 A | 10/1974 | McGuire | | |
| 4,526,355 A | 7/1985 | Moore et al. | | |

(Continued)

OTHER PUBLICATIONS

Merriam-Webster, Definition of "Anterior", May 18, 2016, http://www.merriam-webster.com/dictionary/anterior.*

*Primary Examiner* — Nicholas Polito
(74) *Attorney, Agent, or Firm* — Lowry Blizseth LLP; Scott M. Lowry

(57) ABSTRACT

The improved positioning device, for use in hip, pelvis or bariatric surgery, securely and safely supports a morbidly obese patient lying in the lateral decubitus position at one side of an operating table so the surgeon may stand close to the anterior side of the patient. The support device includes a double-ended bracket having a pair of oppositely positioned padded end portions secured to an angular bracket post adapted to securely mount to an operating table via a question mark-shaped bracket. The angular bracket arm vertically adjusts to support the patient on one side, with the padded end portions applied to bony prominences such as the symphysis pubis and the lower side anterior superior iliac spine. The support device is used in combination with a posterior pelvic support plate, and a pair of anterior-posterior chest support plates to retain the patient in a secure and stable manner during surgery.

26 Claims, 3 Drawing Sheets

(56) References Cited

U.S. PATENT DOCUMENTS

| | | | | |
|---|---|---|---|---|
| 4,583,725 | A | 4/1986 | Arnold | |
| 4,766,892 | A | 8/1988 | Kreitman | |
| 4,913,413 | A | 4/1990 | Raab | |
| 5,390,383 | A * | 2/1995 | Carn | A61G 13/12 128/877 |
| 6,311,349 | B1 * | 11/2001 | Kazakia | A61G 13/12 128/845 |
| 2007/0011814 | A1 * | 1/2007 | Rotert | A61G 13/12 5/646 |
| 2012/0103344 | A1 * | 5/2012 | Hunter, Jr. | A61F 5/3761 128/845 |
| 2014/0190488 | A1 * | 7/2014 | Robran | A61G 99/00 128/845 |

* cited by examiner

ANTERIOR PELVIC SUPPORT DEVICE FOR A SURGERY PATIENT

BACKGROUND OF THE INVENTION

The present invention is directed generally to improvements in surgical support devices for positioning and retaining a patient during a surgical procedure. More specifically, the invention relates to a surgical support device having design improvements related to securely and safely supporting an obese surgical patient in a position laying on one side justified on the operating table in close proximity to the operating surgeon during hip, pelvis or bariatric surgery.

A variety of patient support devices are generally known in the art for use in supporting a surgery patient under anesthesia on an operating table in a predetermined and substantially fixed position to facilitate certain surgical procedures. In this regard, such patient support devices are especially useful to support a surgery patient in a position lying on one side, commonly referred to as a lateral decubitus position, to facilitate surgical procedures such as hip, pelvis or bariatric surgery. The support devices are typically mounted by clamps or the like onto side edges of the operating table, and provide upstanding support plates for engaging the patient anteriorly and posteriorly in the pelvic region and the chest region. Secure patient retention can be extremely important in the course of some surgical procedures such as hip arthroplasty wherein it is desirable to retain the patient in a fixed reference position relative to the operating table to achieve optimum fit and function of a hip prosthesis. The supports should also be of such strength and stability that the operating table can be tilted from side to side to support the patient. Unfortunately, conventional patient support devices, such as the device shown and described with respect to U.S. Pat. No. 5,390,383 (hereinafter "the '383 patent"), the contents of which are herein incorporated by reference, use paddle-shaped, round peg-like or rectangular upstanding plates that tend to engage soft tissues in the anterior pelvic region, resulting in inadequate patient support and retention in supporting obese patients. The support device of the '383 patent does engage the boney prominences of the anterior pelvic region, but the upright support and fixation mechanism can undesirably engage the protuberant abdomen of the obese patient. Also, prior art devices prevent the patient from being positioned toward the front edge of the operating table so the surgeon can be closely positioned to the anterior of the patient during surgery. Supporting the patient by contacting soft tissue, especially in the anterior pelvic region, have sometimes resulted in circulatory restrictions and/or other complications attributable to the pressure applied to skin or to vital organs.

There exists, therefore, a significant need for improvements in patient support devices designed to securely and safely engage the anterior pelvic region of an obese surgery patient lying in a lateral decubitus position. In particular, such a support device should include a double-ended bracket-arm having a deep recess in a central portion thereof to accommodate the protuberant abdomen, said central portion of the bracket-arm being fixed to an angular bracket post mounted to an offset, angular, anteriorly justified bracket in the general shape of a question mark to minimize protuberant abdomen engagement and to position said patient in close proximity to a front edge of the operating table. The present invention fulfills this need and provides other related advantages.

SUMMARY OF THE INVENTION

In accordance with the embodiments described herein, an improved anterior pelvic support device is provided for positioning and retaining an obese surgery patient in a predetermined reference position lying on one side on an operating table, thereby facilitating surgical procedures such as hip surgery, pelvic surgery, bariatric surgery, etc. In particular, the anterior pelvic support device is used in combination with other conventional support devices applied to the posterior pelvic region and the chest region at the anterior and posterior sides of the patient. The anterior pelvic support device is adjustably mounted with respect to an operating table and includes a pair of spaced-apart padded enlarged end portions for engaging the patient at a pair of spaced-apart points, particularly such as the bony prominences defined by symphysis pubis and anterior superior iliac spine.

In accordance with one preferred embodiment, the improved anterior pelvic support device includes a double-ended bracket arm having a deep recess in a central portion thereof to accommodate a protuberant abdomen of a surgery patient. In particular, the deep offset central portion is offset away from the patient relative to the pair of padded elements to prevent compression of vital structures between the engaged boney prominences of the symphysis pubis and the down side anterior iliac spine of the pelvis. An upwardly and inwardly angularly extending bracket post adjustably connects to the an operating table and carries the double-ended bracket-arm at one end thereof and in a position for forward engagement with boney protuberances of the anterior pelvis of the surgery patient. Furthermore, a support bracket may selectively support the bracket post in an anteriorly offset position justified relative to one side of the operating table advantageously providing additional stabilization in the event the operating table needs to be moved or angled during surgery. In a preferred embodiment, the support bracket may be in the shape of a question mark and aligned flush or slightly offset from the operating table end.

Additionally, the improved pelvic support device may further include a mount that permits selective slide coupled clamping of the angularly extending bracket post relative to the question mark-shaped bracket. This enables the support device to be positioned offset from the operating table, yet in a position to stabilize the surgery patient in close proximity to the front edge of the operating table. In this respect, the angular bracket post may extend upwardly and inwardly at an angle between 25 and 35 degrees, and preferably at about 30 degrees, to provide the desired extension over the surface of the operating table. The bracket arm itself is preferably offset from its longitudinal axis relative to the longitudinal axis of the surgery patient by an angle between 45 and 55 degrees, and more preferably by approximately 50 degrees so the bracket arms adequately contact the aforementioned boney prominences.

In an alternative embodiment, the support bracket may include a first vertical extension configured for selective engagement with an operating table side rail, a lower horizontal extension coincident and parallel relative to an upper horizontal extension spaced apart therefrom by a second vertical extension. The upper horizontal extension is preferably configured for slide-in reception and locking of the bracket post. This permits the bracket post to be horizontally adjustable, i.e., the bracket post may be positioned relative to the operating table depending on the size of the surgery patient. In this respect, the lower horizontal extension preferably bends away from the surgery patient and the upper horizontal extension bends toward the surgery patient so that the bracket support double backs on itself to remain offset from the operating table, while allowing the bracket post to angularly extend over the operating table for patient engagement. In one embodiment, the bracket post may fixedly couple to the bracket arm to prevent relative rotational movement. Additionally, the deep recess in the double-ended bracket may include an arcuate cut-out in a central portion thereof to permit engagement of the double-ended bracket with a symphysis pubis and an anterior superior iliac spine of the surgery patient, while allowing for abdominal fat (panniculus) to fit therebetween and over the bracket arm. In this respect, the double-ended bracket may include a pair of support plates formed on opposite ends of the bracket arm to provide padded support. The deep recess may angularly extend inwardly and away from the support plates to provide further positional patient accommodation.

In another preferred embodiment, the improved anterior pelvic support device for securely and safely engaging an anterior pelvic region of a surgery patient lying in a lateral decubitus position includes a double-ended bracket arm that includes a deep recess in a central portion thereof to accommodate a protuberant abdomen of a surgery patient. The double-ended bracket arm may include a pair of support plates formed on opposite ends thereof, with an arcuate cut-out therein to permit engagement of the support plates with a symphysis pubis and an anterior superior iliac spine of the surgery patient while allowing for abdominal fat (panniculus) to fit therebetween and over the bracket arm. A bracket post extending upwardly and inwardly at an angle between 25 and 35 degrees may adjustably connect to an operating table and fixedly coupled to the double-ended bracket-arm at one end thereof to prevent relative rotational movement. The bracket post is positioned in this respect for forward engagement with boney protuberances of an anterior pelvis of the surgery patient from the operating table side edge, especially when used in association with the below-mentioned support bracket.

In this respect, the support bracket is preferably configured to selectively support the bracket post in an anteriorly offset position justified to and in a non-encroaching position relative to one side of the operating table. The bracket support may include a question mark-shaped bracket selectively engageable with the bracket arm and mountable to the operating table. The longitudinal axis of the bracket arm is preferably offset from the longitudinal axis of the surgery patient by an angle between 45 and 55 degrees, or more specifically by about 50 degrees. The support bracket may include a first extension configured for selective engagement with a side rail of the operating table, a second extension bending away from the surgery patient and coincident with a third extension bending toward the surgery patient. The second and third extensions may be vertically spaced apart from each other by a fourth vertical extension relatively smaller than the first vertical extension. The third extension is configured for slide-in reception of the bracket post anteriorly offset from one side of the operating table, and may include a mount for slide coupled clamping of the bracket post relative to the question mark-shaped bracket.

In another embodiment, the improved anterior pelvic support device includes a double-ended bracket arm having a deep recess with an arcuate cut-out therein. The central portion of the double-ended bracket arm angularly extends inwardly away from a pair of support plates designed to support an anterior pelvic region and accommodate a protuberant abdomen of a surgery patient. The bracket arm is preferably offset along its longitudinal axis relative to the longitudinal axis of the surgery patient by an angle between 45 and 55 degrees. An upwardly and inwardly angularly extending bracket post is adjustably connected to an operating table on one end and the double-ended bracket-arm at the other. To this end, the double-ended bracket arm extends into a forward position for engagement with boney protuberances of an anterior pelvis of the surgery patient.

Furthermore, a question mark-shaped bracket selectively engageable with the bracket arm and mountable to a side edge of the operating table may further facilitate edge mounting of the double ended bracket arm relative to the surgery patient. Here, the question mark-shaped bracket selectively supports the bracket post in an anteriorly offset position justified relative to one side of the operating table. For instance, the question mark-shaped bracket may include a first vertical extension configured for selective engagement with a side rail of the operating table and a lower horizontal extension coincident relative to an upper horizontal extension spaced apart therefrom by a second vertical extension. The upper horizontal extension being configured for slide-in reception of the bracket post, which may include a mount to selectively slide clamp the bracket post relative to the question mark-shaped bracket. To this end, the lower horizontal extension may bend away from the surgery patient and the upper horizontal extension may bend toward the surgery patient so that the bracket post mounts to the support bracket anteriorly offset from a side of the operating table and fixedly relative to the surgery patient.

Furthermore, in another preferred embodiment as discussed herein, the improved anterior pelvic support device for securely and safely engaging an anterior pelvic region of a surgery patient lying in a lateral decubitus position includes a double-ended bracket arm having a deep recess including an arcuate cut-out in the central portion thereof to permit engagement of a pair of support plates formed on opposite ends of the double-ended bracket with a symphysis pubis and an anterior superior iliac spine of the surgery patient while accommodating panniculus therebetween. An upwardly and inwardly angularly extending bracket post adjustably connects to an operating table at one end and the double-ended bracket-arm at another end, to position the double-ended bracket-arm in a position for forward engagement with boney protuberances of an anterior pelvis of the surgery patient. Furthermore, a support bracket having a first relatively elongated vertical extension configured for selective engagement with a side rail of the operating table and a second substantially horizontal extension bending away from the surgery patient and coincident and relatively parallel with a third substantially horizontal extension generally bending toward the surgery patient and spaced apart therefrom by a fourth relatively shortened vertical extension, may further facilitate side rail or operating table adjacent side mounting of the aforementioned double-ended bracket-arm. In this respect, the third extension may be configured for slide-in reception and locking of the bracket post anteriorly offset from a side of the operating table. A mount or other clamp may permit selective slide coupled clamping of the angularly extending bracket post relative to the support bracket to position the surgery patient in close proximity to a front edge of the operating table.

Moreover, the support device may also include a double-ended bracket-arm having a central portion joined to a pair of enlarged opposite ends disposed generally coplanar to each other and offset from the plane of the central portion. A pair of padded elements may be removably carried on opposite ends of the bracket-arm such that the bracket-arm defines a pair of spaced-apart padded support members. A central portion of the double-ended bracket-arm includes a deep recess to allow room for the protuberant abdomen. In particular, the deep offset central portion is offset away from the patient relative to the pair of padded elements to prevent compression of vital structures between the engaged boney prominences of the symphysis pubis and the down side anterior iliac spine of the pelvis.

The central portion of the bracket-arm is fixed to an angular bracket post to minimize engagement of the protuberant abdomen, which in turn allows the patient to be positioned closer to the side edge of the operating table. The angular bracket post further keeps the support device out of the way of the surgeon leaning over the operating table. The fixed connection between the angular bracket post and bracket arm prevents the bracket arm from rotating during surgery. Such rotation may reduce the support provided by the support device and lead to complications. The horizontal portion of the angular bracket post is mounted in turn as by clamping to a question mark-shaped bracket secured as by clamping to a side rail extending along the side edge of the operating table. The question mark-shaped bracket is configured to allow the angular bracket post to be moved closer to the edge of the operating table than other L-shaped angle brackets known in the art. The clamp-on mounting of the angular bracket post permits anterior-posterior adjustment of the bracket arm relative to the operating table.

Preferably, the improved anterior pelvic support device is used in combination with conventional patient support plates for securely and safely retaining the patient during surgery. In this respect, a posterior pelvic support plate engages the relatively bony posterior pelvic region and a pair of anterior and posterior chest support plates engage the patient in the region of the sternum and near the base of the scapula, respectively, to securely and safely support an obese surgical patient in a position laying on one side toward a front end of an operating table in close proximity to the operating surgeon during hip, pelvis or bariatric surgery.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
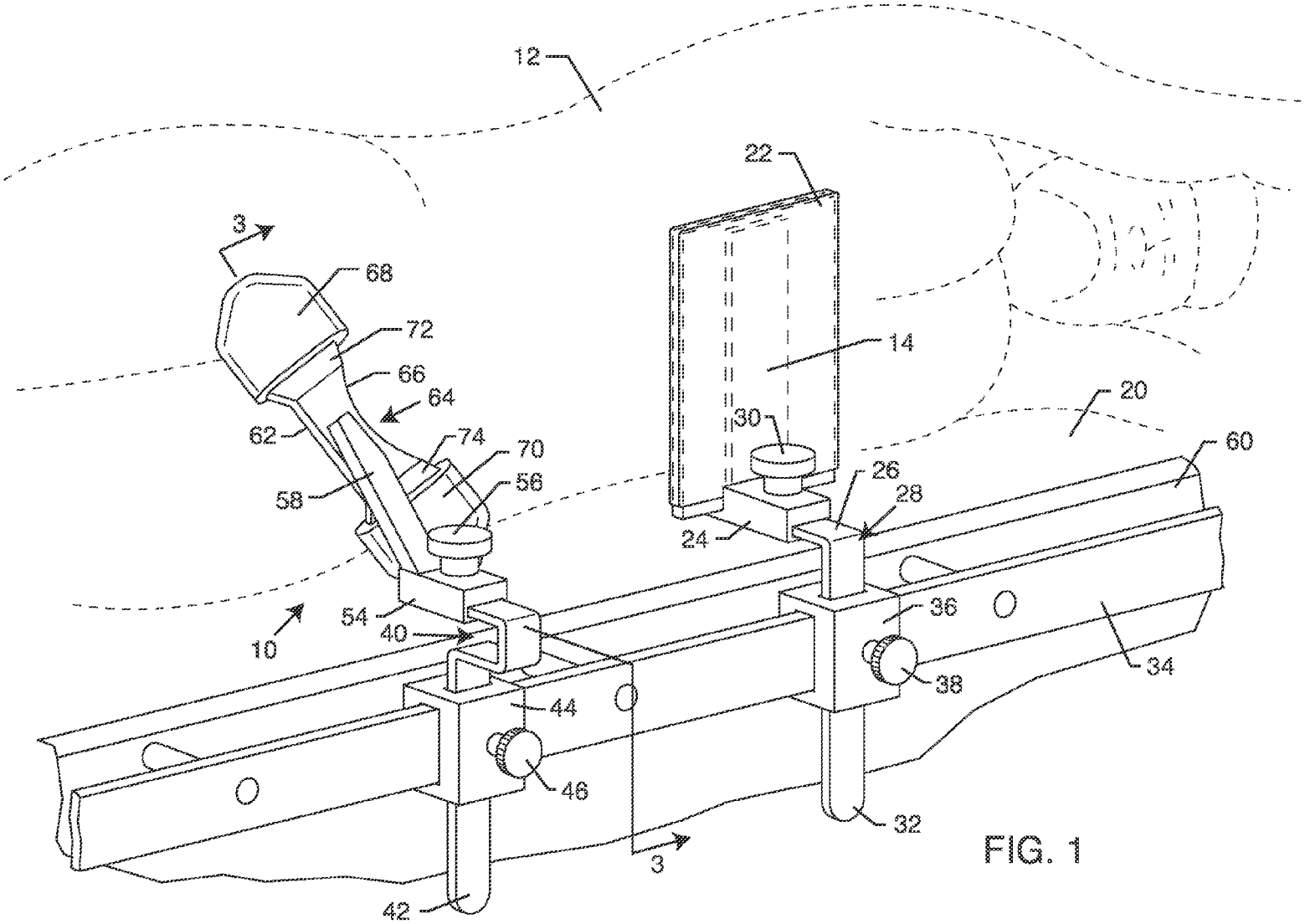
FIG. 1 is a fragmented perspective view illustrating an anterior pelvic support device embodying the anterior pelvic support device disclosed herein.

As shown in the exemplary drawings, an improved support device referred to generally by the reference numeral 10 is provided for engaging and supporting the anterior pelvic region of a surgery patient 12. The anterior pelvic support device 10 is designed for use in combination with other conventional upstanding support plates 14, 16 and 18 (FIGS. 1 and 2) for retaining the patient 12 in a position lying on one side, thereby facilitating certain surgical procedures such as hip surgery and/or pelvic surgery. The improved support device 10 is particularly useful in allowing the patient to be justified closer to the anterior side of an operating table (patient decubitus) to allow a surgeon to be closer to the wound for the anterior (decubitus) approach to hip replacement surgery. This may also be an advantage for bariatric surgery or retroperitoneal surgery. In particular, the device 10 retains and supports an obese patient without substantial compression of vital organs from a protuberant abdomen.

The improved support device 10 recognizes that complications sometimes arise as a result of improper and/or inadequate patient positioning and retention during a surgical procedure. Such complications are particularly likely when significant force or pressure is required to retain the patient in a predetermined orientation while under an anesthetic, such as an inherently unstable position lying on one side, often referred to as the lateral decubitus position. In the past, conventional support devices in the form of flat upstanding support plates, rectangular plates or round cylinders have been used to support the patient by engaging soft tissues in the anterior pelvic region, resulting in potential circulatory restriction and/or other complications arising as a result of pressure applied to skin and internal organs. Some surgeries require the patient to be adjusted on the operating table close to the operating surgeon. In this respect, obese patients have unique considerations due to protuberant abdomens. In addition, especially in hip arthroplasty wherein it is desired to retain the patient in a substantially fixed reference position relative to an operating table 20, anterior pelvic support by engagement of soft tissues has not provided adequate patient retention to ensure optimum fit and function of an implanted prosthesis.

Figure 2:
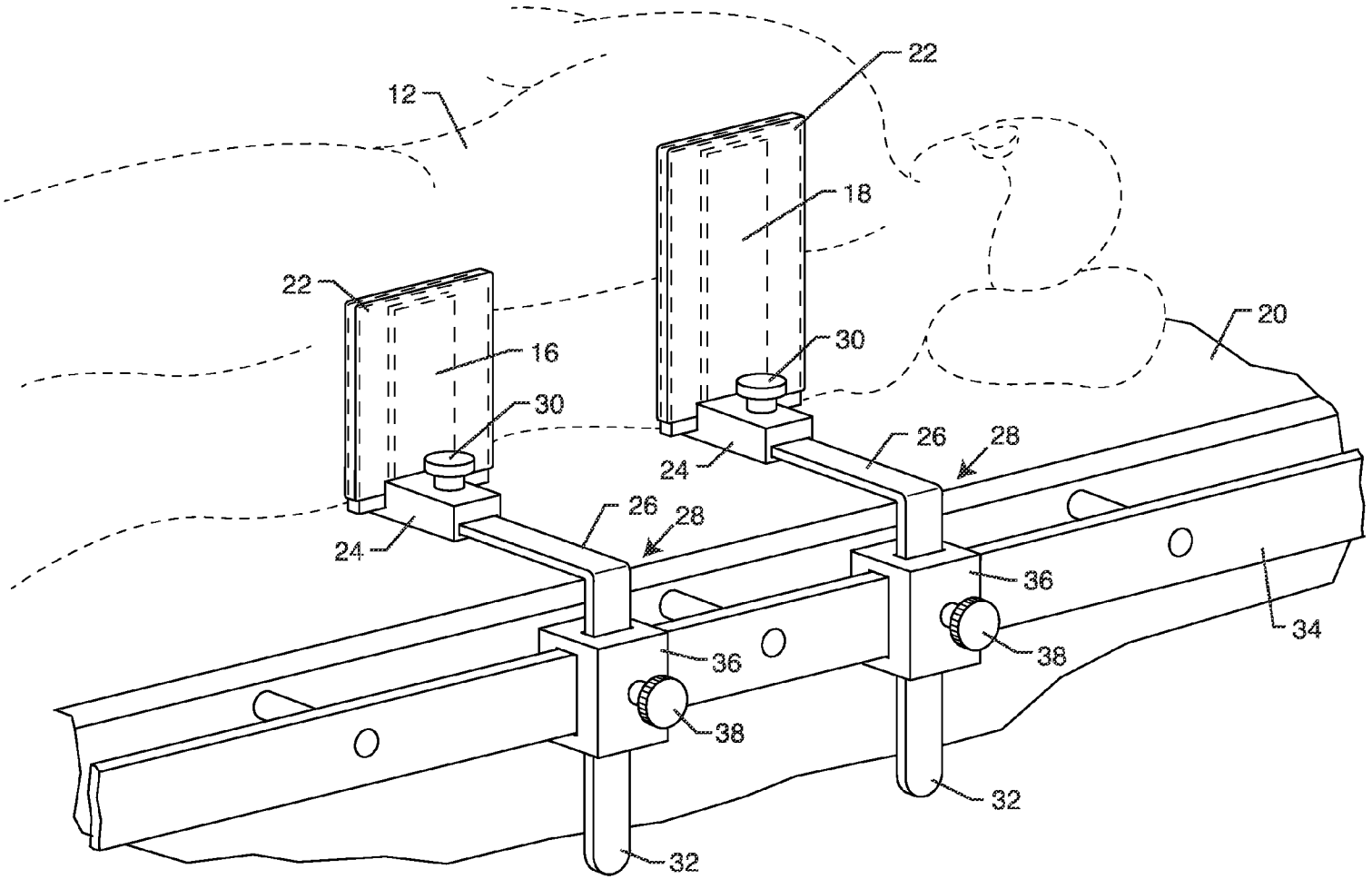
FIG. 2 is a fragmented perspective view illustrating posterior support devices for supporting a surgery patient.

Therefore, the improved support device 10 shown in generally in FIGS. 1 and 2 is used to support the anterior pelvic region of the patient 12, in combination with the generally conventional flat support plates 14, 16 and 18 for engaging the patient at multiple locations other than the anterior pelvic region. More specifically, the flat and generally paddle-shaped support plates 14, 16 and 18 are each normally covered by a soft foam or fabric padding 22 and mounted in an upstanding position adjacent the patient 12 by a clamp base 24 adapted for slide-fit mounting onto the horizontal leg 26 of an L-shaped angle bracket 28. A clamp screw 30 releasably secures the clamp base 24 to the L-shaped angle bracket 28 at an adjustably selected position spaced inwardly from the adjacent side edge of the operating table 20. The horizontal leg 26 of each L-shaped angle bracket 28 extends laterally to the side edge of the table 20, whereat a vertical leg 32 of the angle bracket 28 extends downwardly past a side rail 34. A side clamp 36 includes a clamp screw 38 for securely attaching the vertical leg 32 to the table side rail 34. As shown in FIGS. 1 and 2, the support plate 14 includes an anterior chest support for engaging the patient 12 generally in the bony region of the sternum, while the support plates 16 and 18 respectively include posterior pelvic and chest supports engaging the patient 12 in the bony regions defined by the bony posterior pelvic region and by the scapula. The combination of patient support devices are thus provided in anterior-posterior pairs for engaging and supporting the patient 12 on opposite sides. The position of each support plate 14, 16 and 18 is, of course, adjustably set in conformance with the anatomical geometry of each specific patient.

The anterior pelvic support device 10 additionally uses a question mark-shaped bracket 40 adjustably secured to the table side rail 34 on the anterior side of the patient 12. More particularly, the question mark-shaped bracket 40 includes a vertical leg 42 that selectively slides into a side clamp 44 having a clamp screw 46 for adjustable mounting of the question mark-shaped bracket 40 relative to the operating table. The relative positioning of the vertical leg 42 determines the overall vertical height of the support device 10. More specifically, the vertical leg 42 forms a part of the question mark-shaped bracket 40 with a substantially horizontal lower extension 48 that bends outward relative to the operating table 20 and away from the vertical leg 42 at an approximate 90° angle. A relatively shorter vertical extension 50 is generally formed at a 90° angle relative to the horizontal lower extension 48 and at an opposite end thereof relative to the vertical leg 42, this vertical extension 50 then bending at a relative 90° angle back toward the operating table 20 to form a substantially horizontal upper extension 52 to form the question mark-shaped bracket 40. This upper extension 52 selectively slidably engages a side clamp 54 for selective releasable attachment to the support device 10 by a clamp screw 56.

Figure 3:
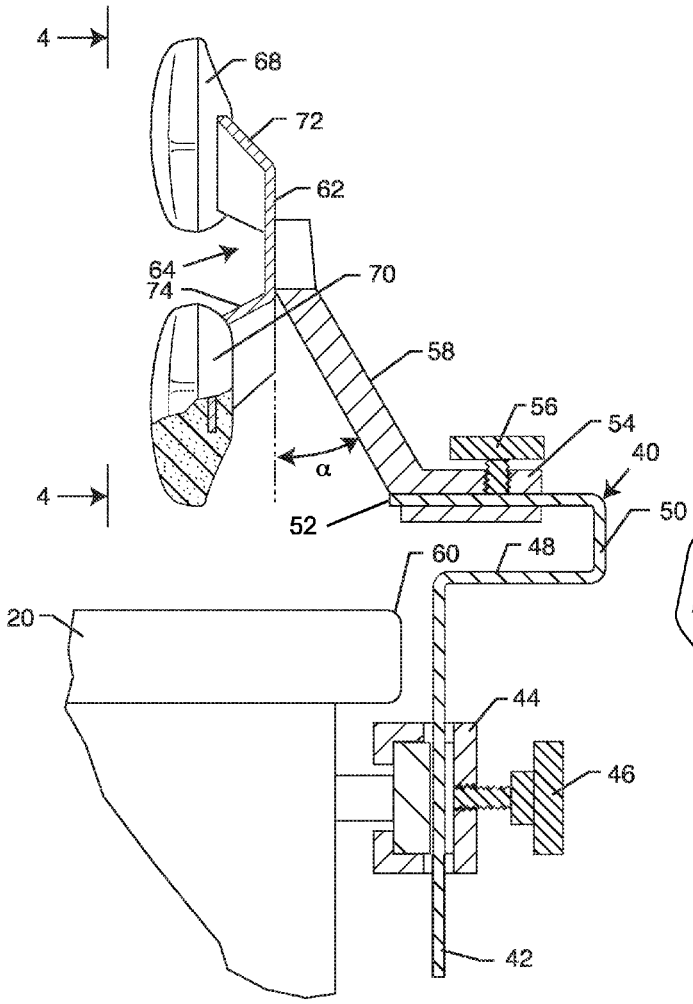
FIG. 3 is an enlarged fragmented vertical sectional view taken generally on the line 3-3 of FIG. 1.

In this respect, the question mark-shaped bracket 40 provides a mechanism for mounting the support device 10 without encroaching into the depth of the operating table 20 as best shown in FIG. 3. Here, the side clamp 54 is shown being formed integral with an angular bracket post 58. This angular bracket post 58 has an angular offset $\alpha$ of approximately 30° to position the support device 10 inward from a side edge 60 of the operating table 20 and toward the patient 12, although the angular offset $\alpha$ may be between 25° and 35°. This angular offset $\alpha$ allows the patient 12 to be positioned closer to the side edge 60 of the operating table 20 and away from the abdominal fat (panniculus), while keeping the support device 10 low and out of the way of the surgeon leaning over the operating table 20. Furthermore, the construction of the question mark-shaped bracket 40 permits mounting of the support device 10 thereto in front of the side edge 60 of the operating table 20 in the manner shown in FIG. 3 by offsetting the upper horizontal extension 52 from the lower horizontal extension 48 by a distance that includes the length of the vertical extension 50. This permits selectively slide-mounting of the upper extension 52 with the side clamp 54. The horizontal extensions 48, 52 otherwise remain substantially parallel and coincident so that the support device 10 remains offset or substantially flush with the side edge 60 of the operating table 20. The inwardly extending angular bracket post 58 extends the support device 10 back toward the patient 12 for preferred supportive positioning of the patient 12 toward the leading edge 60 of the operating table 20 in a manner not previously achievable with the prior art devices, such as Applicant's own device shown and described in the '383 patent.

The support device 10 includes a bracket arm 62 preferably integrally formed from or fixed to the angular bracket post 58. The recessed bracket arm 62 is preferably structurally reinforced by direct fixation to the angular bracket post 58 at a central portion 64 thereof such that the support device 10 retains a low profile. Attachment at this location allows for a deep recess therein that does not otherwise compromise the structural integrity and strength of the bracket arm 62. In this respect, the bracket arm 62 attaches to the angular bracket post 58 in this manner to substantially reduce the overall dimensions of the support device 10 and to provide additional clearance and less encumberment for the protuberant abdomen. That is, the support device 10 provides more room for the overhanging panniculus of the obese patient. One advantage over the devices known in the prior art, including the embodiments disclosed in the '383 patent, is the elimination of the undesirable prominent thumbscrew nut and adjustable bracket post, which can cause interference with a particularly large protuberant abdomen in obese patients. Additionally, forming or fixing the bracket arm 62 to the angular bracket post 58 cures problems associated with the prior art devices that allow the support device 10 to rotate during surgery. Rotating devices are particularly problematic in the event the surgeon may need to tilt or reposition the operating table 20 to gain better access to the surgery patient 12. In this respect, an insufficiently tightened thumbscrew nut may loosen prior art devices such that the device no longer provides the requisite support during surgery.

The central portion 64 of the bracket arm 62 includes a generally arcuate cut-out or recess 66 that provides clearance for unencumbered placement of a protuberant abdomen when the support device 10 is placed at the correct position and angle such that a pair of end portions 72, 74, which are covered in end portion pads 68, 70, engage the symphysis pubis and a down side anterior superior iliac spine, respectively, of the boney pelvis. The preferred attachment angle is about 50° long axis of the patient 12 relative to the long axis of the bracket arm 62, but may be between 45° and 55°. The end portions 72, 74 are substantially co-planar and extend toward the patient 12 (best shown in FIGS. 1 and 3). As shown, the end portions 72, 74 diverge from one another and angle inwardly toward the patient 12 from the central portion 64 to form a gap or space (greater than the one disclosed in the '383 patent) therein to further accommodate the protuberant abdomen. Preferably, the end portions 72, 74 are covered with an end portion pads 68, 70, which are a respective slip-on pad or other comparable cushion, such as closed cell foam or the like that slip-fits over the end portions 72, 74.

The deep offset of the central portion 64 of the bracket arm 62 in the outward or outboard direction from opposite ends defines the spaced-apart pair of substantially coplanar support members or end portions 72, 74 for the device 10. This prevents compression of the vital structures of the groin when the support device 10 is placed in close proximity to and supports the patient 12 at the symphysis pubis and anterior superior iliac spine. The specific positions of these end portions 72, 74 are adjustably selected by appropriate loosening of the thumbscrew nut 46 to accommodate vertical displacement of the vertical leg 42 of the question mark-shaped bracket 40, the angular bracket-post 58 and the bracket arm 62. The thumbscrew nut 46 is tightened to securely retain the vertical leg 42 and the question mark-shaped bracket 40, the angular bracket-post 58 and the bracket arm 62 in a fixed vertical position relative to the operating table 20.

Figure 4:
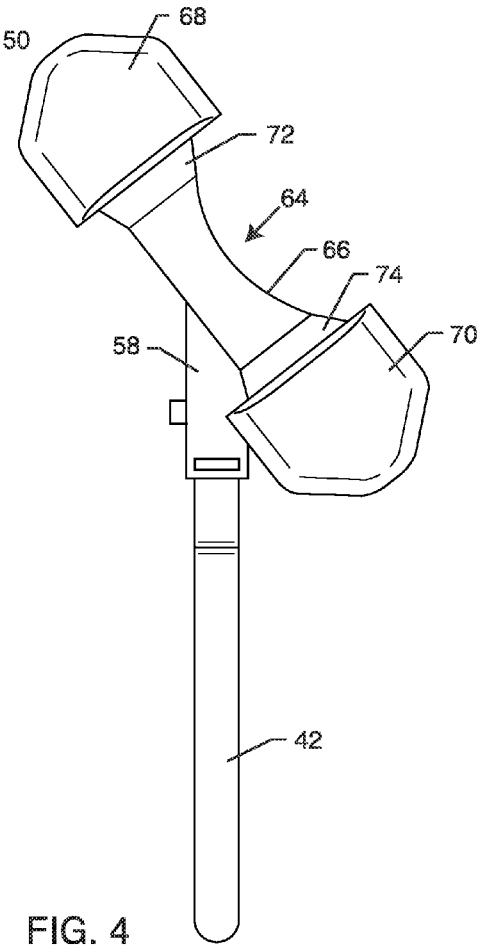
FIG. 4 is a front side elevational view of the anterior pelvic support device, taken generally on the line 4-4 of FIG. 3.

In accordance with the preferred orientation of the support device 10, the end portions 72, 74 are oriented to contact bony prominences at the anterior pelvic region of the patient 12. Specifically, the bracket arm 62 is normally rotated relative to the angular bracket post 58, as shown in FIG. 4. The upper end portion 72 is carefully positioned for engaging and supporting the symphysis pubis of the patient 12. Appropriate angular orientation of the bracket arm 62 also positions the lower end portion 74 to engage and support the anterior superior iliac spine at the lower side of the patient 12. The two end portions 72, 74, each covered by end portion pads 68, 70, thus engage and support the patient 12 at spaced-apart bony prominences, whereby direct application of significant retention pressure to soft tissues and resultant associated complications are avoided. Moreover, the patient 12 is securely retained in a substantially fixed position of reference with respect to the operating table 20. As shown in FIG. 4, the bracket arm 62 is typically oriented at an angle of about 50° relative to the upstanding angular bracket post 58.

A variety of modifications and improvements to the anterior pelvic support device shown and described herein will be apparent to those skilled in the art. Accordingly, no limitation on the invention is intended by way of the foregoing description and accompanying drawings, except as set forth in the appended claims.

What is claimed is:

1. An improved anterior pelvic support device, comprising:

a double-ended bracket arm having a deep recess in a central portion thereof to accommodate a protuberant abdomen of a surgery patient; and a bracket post upwardly and inwardly angularly extending relative to a support bracket and adjustable relative to an operating table, said bracket post carrying said double-ended bracket-arm at one end thereof and in a position for forward engagement with boney protuberances of an anterior pelvis of said surgery patient while simultaneously forming a gap between said double-ended bracket arm and said operating table to minimize engagement with adipose of said surgery patient, wherein said support bracket selectively supports said bracket post in a non-encroaching position relative to one side of said operating table.

2. The improved device of claim 1, wherein said support bracket selectively supports said bracket post in an anteriorly offset position justified relative to one side of said operating table.

3. The improved device of claim 1, including a question mark-shaped bracket selectively engageable with said bracket arm and mountable to said operating table.

4. The improved device of claim 3, including a mount permitting selective slide coupled clamping of said angularly extending bracket post relative to said question mark-shaped bracket to position said surgery patient in close proximity to a front edge of said operating table.

5. The improved device of claim 1, wherein said angular bracket post extends upwardly and inwardly at an angle between 25 and 35 degrees.

6. The improved device of claim 1, wherein a longitudinal axis of said bracket arm is offset from a longitudinal axis of said surgery patient by an angle between 45 and 55 degrees.

7. The improved device of claim 1, wherein said support bracket comprises a first vertical extension configured for selective engagement with a side rail of said operating table, a lower horizontal extension coincident and parallel relative to an upper horizontal extension spaced apart therefrom by a second vertical extension, said upper horizontal extension configured for slide-in reception and locking of said bracket post.

8. The improved device of claim 7, wherein said lower horizontal extension bends away from said surgery patient and said upper horizontal extension bends toward said surgery patient, said bracket post mounts to said support bracket anteriorly offset from a side of said operating table.

9. The improved device of claim 1, wherein said deep recess includes an arcuate cut-out in said central portion of said bracket arm to permit engagement of said double-ended bracket with a symphysis pubis and an anterior superior iliac spine of said surgery patient while allowing for abdominal fat to fit therebetween and over said bracket arm.

10. The improved device of claim 1, wherein said bracket post fixedly couples to said bracket arm to prevent relative rotational movement.

11. The improved device of claim 1, including a pair of support plates formed on opposite ends of said double-ended bracket arm.

12. The improved of claim 11, wherein said deep recess angularly extends inwardly away from support plates.

13. An improved anterior pelvic support device for securely and safely engaging an anterior pelvic region of a surgery patient lying in a lateral decubitus position, comprising:

a double-ended bracket arm having a deep recess in a central portion thereof to accommodate a protuberant abdomen of a surgery patient; and a bracket post extending upwardly and inwardly at an angle between 25 and 35 degrees relative to a support bracket and forming a gap between said double-ended bracket arm and an operating table to minimize engagement with a protuberant abdomen of said surgery patient and adjustably connectable to said operating table, said bracket post fixedly coupled to said double-ended bracket-arm at one end thereof to prevent relative rotational movement, and in a position for forward engagement with boney protuberances of an anterior pelvis of said surgery patient, the support bracket selectively supporting said bracket post in an anteriorly offset position justified to and in a non-encroaching position relative to one side of said operating table.

14. The improved anterior pelvic support device of claim 13, wherein said support bracket comprises a question mark-shaped bracket selectively engageable with said bracket arm and mountable to said operating table and wherein a longitudinal axis of said bracket arm is offset from a longitudinal axis of said surgery patient by an angle between 45 and 55 degrees.

15. The improved anterior pelvic support device of claim 14, wherein said longitudinal axis of said bracket arm is offset from said longitudinal axis of said surgery patient by an angle of about 50 degrees.

16. The improved anterior pelvic support device of claim 14, including a mount permitting selective slide coupled clamping of said bracket post relative to said question mark-shaped bracket to position said surgery patient in close proximity to a front edge of said operating table.

17. The improved anterior pelvic support device of claim 13, wherein said support bracket comprises a first extension configured for selective engagement with a side rail of said operating table, a second extension bending away from said surgery patient and coincident and parallel relative to a third extension bending toward said surgery patient and spaced apart therefrom by a fourth extension, said third extension configured for slide-in reception and locking of said bracket post anteriorly offset from one side of said operating table.

18. The improved anterior pelvic support device of claim 13, including a pair of support plates formed on opposite ends of said double-ended bracket arm and an arcuate cut-out in said central portion of said bracket arm permitting engagement of said support plates with a symphysis pubis and an anterior superior iliac spine of said surgery patient while allowing for abdominal fat to fit therebetween and over said bracket arm.

19. An improved anterior pelvic support device, comprising:

a double-ended bracket arm including a deep recess having an arcuate cut-out in a central portion angularly extending inwardly away from a pair of support plates formed on opposite ends of said double-ended bracket arm to support an anterior pelvic region and accommodate a protuberant abdomen of a surgery patient, said bracket arm including a longitudinal axis offset from a longitudinal axis of said surgery patient by an angle between 45 and 55 degrees; and a bracket post upwardly and inwardly angularly extending relative to a question mark-shaped bracket selectively engageable with said bracket post and mountable to an operating table, said bracket post carrying said double-ended bracket-arm at one end thereof and in a position for forward engagement with boney protuberances of an anterior pelvis of said surgery patient simultaneously while forming a gap between said double-ended bracket arm and said operating table to minimize engagement with abdomen adipose of said surgery patient.

20. The improved anterior pelvic support device of claim 13, wherein the support bracket includes a rectangular cross-section configured for slide-in engagement with a rectangular channel, the support bracket being unable to roll relative to the rectangular channel due to interference engagement therewith.

21. The improved device of claim 19, wherein said question mark-shaped bracket selectively supports said bracket post in an anteriorly offset position justified relative to one side of said operating table.

22. The improved device of claim 19, including a mount permitting selective slide coupled clamping of said angularly extending bracket post relative to said question mark-shaped bracket, wherein said angular bracket post extends upwardly and inwardly at an angle between 25 and 35 degrees.

23. The improved device of claim 19, wherein said question mark-shaped bracket comprises a first vertical extension configured for selective engagement with a side rail of said operating table, a lower horizontal extension coincident relative to an upper horizontal extension spaced apart therefrom by a second vertical extension, said upper horizontal extension configured for slide-in reception of said bracket post.

24. The improved device of claim 23, wherein said lower horizontal extension bends away from said surgery patient and said upper horizontal extension bends toward said surgery patient, said bracket post mounts to said support bracket anteriorly offset from a side of said operating table and fixedly couples to said bracket arm to prevent relative rotational movement.

25. The improved device of claim 19, wherein said longitudinal axis of said bracket arm is offset from said longitudinal axis of said surgery patient by an angle of about 50 degrees.

26. An improved anterior pelvic support device for securely and safely engaging an anterior pelvic region of a surgery patient lying in a lateral decubitus position, comprising:

a double-ended bracket arm having a deep recess comprising an arcuate cut-out in said central portion thereof to permit engagement of a pair of support plates formed on opposite ends of said double-ended bracket with a symphysis pubis and an anterior superior iliac spine of said surgery patient while accommodating panniculus therebetween and over said arcuate cut-out;

a bracket post upwardly and inwardly angularly extending relative to a support bracket and adjustably connectable to an operating table, said bracket post carrying said double-ended bracket-arm at one end thereof and in a position for forward engagement with boney protuberances of an anterior pelvis of said surgery patient simultaneously creating a gap between said double-ended bracket arm and said operating table to minimize engagement with a protuberant abdomen of said surgery patient;

said support bracket comprising a first relatively elongated vertical extension configured for selective engagement with a side rail of said operating table, a second substantially horizontal extension bending away from said surgery patient and coincident and relatively parallel with a third substantially horizontal extension generally bending toward said surgery patient and spaced apart therefrom by a fourth relatively shortened vertical extension, said third extension configured for slide-in reception and locking of said bracket post anteriorly offset from a side of said operating table; and a mount permitting selective slide coupled clamping of said angularly extending bracket post relative to said support bracket to position said surgery patient in close proximity to a front edge of said operating table.

* * * * *